US012680215B2

(12) United States Patent
Chun et al.

(10) Patent No.: US 12,680,215 B2
(45) Date of Patent: Jul. 14, 2026

(54) CLOTHING TREATMENT APPARATUS

(71) Applicant: Samsung Electronics Co., Ltd., Suwon-si (KR)

(72) Inventors: Kwangmin Chun, Suwon-si (KR); Byeongwoo Kim, Suwon-si (KR); Jonghun Sung, Suwon-si (KR); Doyun Lee, Suwon-si (KR); Geonhui Jo, Suwon-si (KR); Youngchul Jo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 158 days.

(21) Appl. No.: 18/615,937

(22) Filed: Mar. 25, 2024

(65) Prior Publication Data

US 2024/0229332 A1 Jul. 11, 2024

Related U.S. Application Data

(63) Continuation of application No. PCT/KR2022/013473, filed on Sep. 7, 2022.

(30) Foreign Application Priority Data

Oct. 26, 2021 (KR) ..... 10-2021-0143878

(51) Int. Cl.
*D06F 39/02* (2006.01)
*D06F 23/04* (2006.01)
*D06F 25/00* (2006.01)

(52) U.S. Cl.
CPC ..... *D06F 39/022* (2013.01); *D06F 23/04* (2013.01); *D06F 25/00* (2013.01); *D06F 39/024* (2013.01)

(58) Field of Classification Search
CPC ..... D06F 39/022; D06F 39/024
See application file for complete search history.

(56) References Cited

U.S. PATENT DOCUMENTS 11,401,649 B2 8/2022 Ko et al.
11,434,598 B2 9/2022 Deng et al.
11,555,268 B2 1/2023 Jung et al.
(Continued)

FOREIGN PATENT DOCUMENTS

CN 203334043 U 12/2013
CN 205313862 U 6/2016
(Continued)

OTHER PUBLICATIONS

International Search Report of the International Searching Authority dated Jan. 12, 2023, in connection with International Application No. PCT/KR2022/013473, 5 pages.

*Primary Examiner* — Joseph L. Perrin

(57) ABSTRACT

Disclosed herein is a clothing treatment apparatus including a cabinet, a tub disposed within the cabinet, and a detergent supply device configured to supply detergent to the tub, wherein the detergent supply device includes a detergent container configured to store detergent, a housing configured to receive the detergent container and supply the detergent and water to the tub, and a connection tube including an inlet and an outlet, the inlet and the outlet are in communication with the housing so that the detergent supplied from the housing through the inlet can be stored in the connection tube.

22 Claims, 15 Drawing Sheets

(56) References Cited

U.S. PATENT DOCUMENTS

| | | | | |
|---|---|---|---|---|
| 11,795,603 | B2 | 10/2023 | Jung et al. | |
| 2011/0120196 | A1 | 5/2011 | Kim | |
| 2012/0125055 | A1 | 5/2012 | Lee | |
| 2016/0177491 | A1* | 6/2016 | Da Pont | D06F 39/02 222/135 |
| 2020/0232146 | A1* | 7/2020 | Jung | D06F 39/02 |
| 2021/0062395 | A1 | 3/2021 | Jung et al. | |
| 2023/0272571 | A1* | 8/2023 | Chun | D06F 39/022 68/12.18 |
| 2023/0272573 | A1* | 8/2023 | Cheon | D06F 39/02 68/12.18 |

FOREIGN PATENT DOCUMENTS

| | | | |
|---|---|---|---|
| CN | 106245280 | B | 4/2019 |
| CN | 209798357 | U | 12/2019 |
| CN | 210085836 | U | 2/2020 |
| JP | 2010-172547 | A | 8/2010 |
| KR | 10-0140666 | B1 | 8/1998 |
| KR | 10-1125563 | B1 | 3/2012 |
| KR | 10-2012-0053579 | A | 5/2012 |
| KR | 10-1476183 | B1 | 12/2014 |
| KR | 10-2018-0080013 | A | 7/2018 |
| KR | 10-2019-0044228 | A | 4/2019 |
| KR | 10-2020-0091244 | A | 7/2020 |
| KR | 10-2021-0027019 | A | 3/2021 |
| KR | 10-2021-0027090 | A | 3/2021 |

* cited by examiner

CLOTHING TREATMENT APPARATUS

CROSS-REFERENCE TO RELATED APPLICATIONS

This application is a Bypass Continuation of International Application No. PCT/KR2022/013473, filed Sep. 7, 2022, which claims priority to Korean Patent Application No. 10-2021-0143878, filed Oct. 26, 2021, the disclosures of which are herein incorporated by reference in their entirety.

BACKGROUND

1. Field

The disclosure relates to a clothing treatment apparatus, and more particularly, to a clothing treatment apparatus including a detergent supply device.

2. Description of Related Art

In general, a clothing treatment apparatus includes a washing machine that uses a driving force of a motor to rotate clothes and detergent placed in a rotating tub together to wash the clothes by mutual friction, and a drying machine that rotates a rotating tub receiving an object to be dried to dry the object in the rotation.

Such a clothing treatment apparatus may include a detergent supply device provided in a cabinet, and the detergent supply device is a device that allows detergent to be supplied inside a tub. For example, if the detergent is liquid, the liquid detergent may be supplied directly into the tub.

The detergent supply device may include a housing and a detergent container disposed within the housing to accommodate the detergent. In the event that the detergent stored in the detergent container leaks into the housing, a user may recognize this situation as a failure.

SUMMARY

The present disclosure is directed to a clothing treatment apparatus including a detergent supply device capable of receiving detergent leaked into a housing in a state that is invisible to a user.

Further, the present disclosure is directed to a clothing treatment apparatus including a detergent supply device capable of providing a space that may efficiently accommodate residual detergent and residual water.

According to an embodiment of the disclosure, a clothing treatment apparatus includes a cabinet, a tub disposed within the cabinet, and a detergent supply device configured to supply detergent to the tub, wherein the detergent supply device includes a detergent container configured to store detergent, a housing configured to receive the detergent container and supply the detergent and water to the tub, and a connection tube including an inlet and an outlet, the inlet and the outlet are in communication with the housing so that the detergent supplied from the housing through the inlet is able to be stored in the connection tube and the outlet is in communication with the housing at a higher position than the inlet.

A center of the outlet of the connection tube may communicate with the housing at a higher position than a center of the inlet.

A lower end of the outlet of the connection tube may communicate with the housing at a higher position than the center of the inlet.

The housing may include a storage bin configured to receive detergent supplied from the detergent container and communicate with the inlet of the connection tube.

The housing may include a rear wall disposed on a rear side of the detergent container, the rear wall including a blocking portion defining one side of a storage space of the storage bin, and the inlet of the connection tube may communicate with the blocking portion of the rear wall, and the outlet of the connection tube communicates with a different portion of the rear wall.

The clothing treatment apparatus may further include a detergent pump configured to supply detergent from the detergent container to the housing, wherein the housing may include a housing outlet hole forming a passage configured to move the detergent in the detergent container to the detergent pump, and a housing inlet hole configured to supply the detergent passing through the detergent pump into the housing, and the storage bin may receive the detergent supplied from the housing outlet hole or the housing inlet hole.

A pump connector may be formed protruding from a rear side of the detergent container to be coupled with the housing outlet hole of the housing, and the storage bin may receive the detergent leaked from the pump connector.

The clothing treatment apparatus may further include a water supply pipe communicating with the housing to supply water from a water supply source into the housing, wherein the storage bin may receive the water supplied into the housing from the water supply pipe.

The connection tube may form a flow path for the detergent and water received in the storage bin from the inlet to the outlet.

The housing may include a water collection guide formed on an upper portion of the storage bin and inclined downwardly toward the storage bin to guide the water supplied from the water supply pipe to the storage bin.

The housing may include a washing water outlet hole connected to the inlet of the connection tube and a washing water inlet hole connected to the outlet of the connection tube, and a center of the washing water outlet hole is disposed at a lower position than a center of the washing water inlet hole.

The center of the washing water outlet hole may be disposed at a lower position than a lower end of the washing water inlet hole.

The connection tube may be bent in a U shape.

The detergent container may be detachably disposed in the housing.

The housing may include a guide channel elongating on a bottom of the housing to guide the water and detergent introduced into the housing through the outlet of the connection tube to the tub.

According to an embodiment of the disclosure, a clothing treatment apparatus includes a cabinet having an inlet on an upper portion thereof, a tub disposed within the cabinet having an opening on an upper portion thereof, and a detergent supply device disposed on an upper side the tub, wherein the detergent supply device includes a housing, a detergent container configured to supply detergent to the housing, a connection tube communicating with the housing and capable of receiving the water and detergent supplied to the housing, wherein the height of the inlet through which the connection tube is supplied with water and detergent from the housing is lower than the height of the outlet through which the connection tube is supplied with water and detergent to the housing.

The housing may include a storage bin for storing detergent supplied from the detergent container and water supplied from the water supply pipe, and the inlet of the connection tube may communicate with the storage bin.

The center of the inlet may be located lower than the center of the outlet.

The center of the inlet may be located lower than the bottom of the outlet.

The connection tube may be bent in a U shape.

According to the spirit of the present disclosure, it is possible to provide the detergent supply device that can accommodate detergent that has leaked into the housing in a state that is invisible to the user.

According to the spirit of the present disclosure, it is possible to provide the detergent supply device that can efficiently store detergent and water in a small space.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
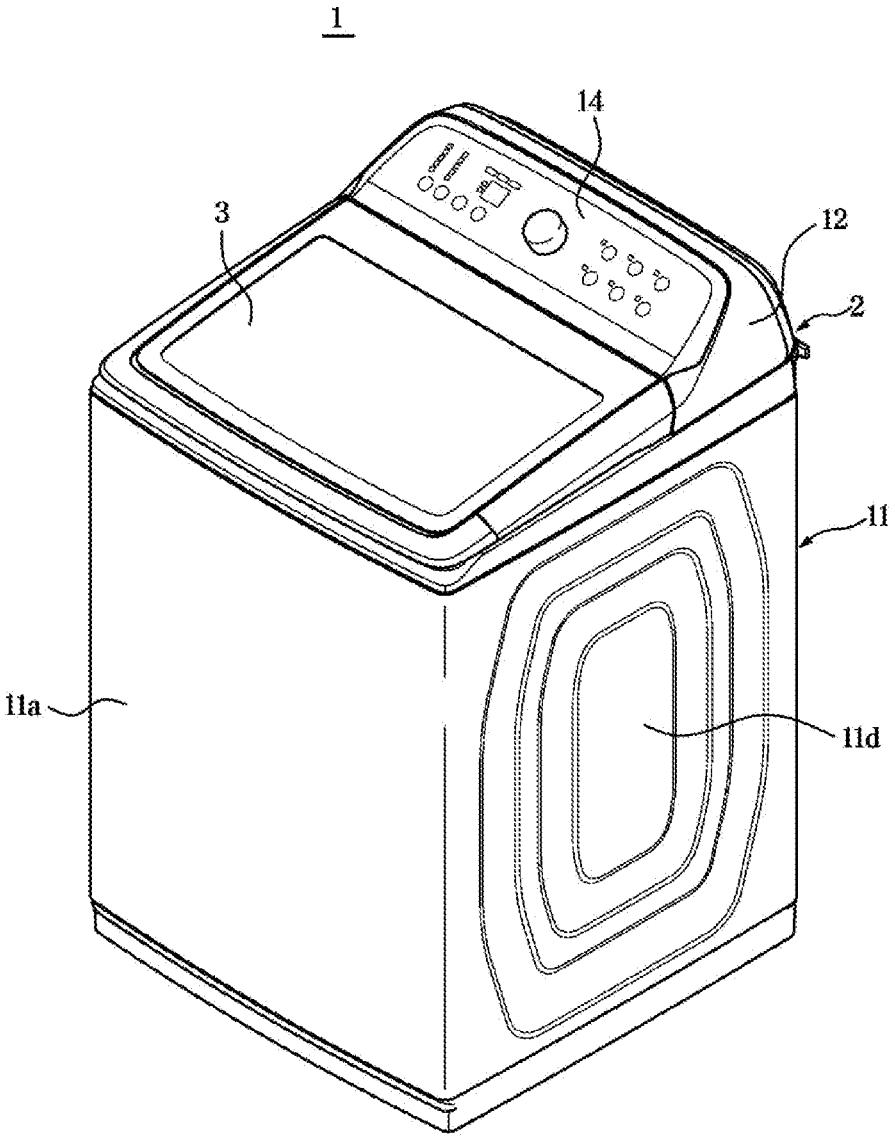
FIG. 1 is a perspective view showing a clothing treatment apparatus according to an embodiment of the present disclosure.

FIGS. 1 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure and may be used in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

As used herein, the terms "front", "rear", "upper", "lower", "left", "right", and the like are defined with reference to the drawings and are not intended to limit the shape and location of each component.

A clothing treatment apparatus according to various embodiments of the present disclosure may include a washing machine, a dryer, a clothes care appliance, and the like. However, for ease of description, embodiments of the present disclosure will be described below based on a top-loading washing machine.

In addition, detergents may include not only detergents for laundry, but also rinses, deodorants, sanitizers, or air fresheners for dryers.

Hereinafter, various embodiments according to the disclosure will be described in detail with reference to the accompanying drawings.

Figure 2:
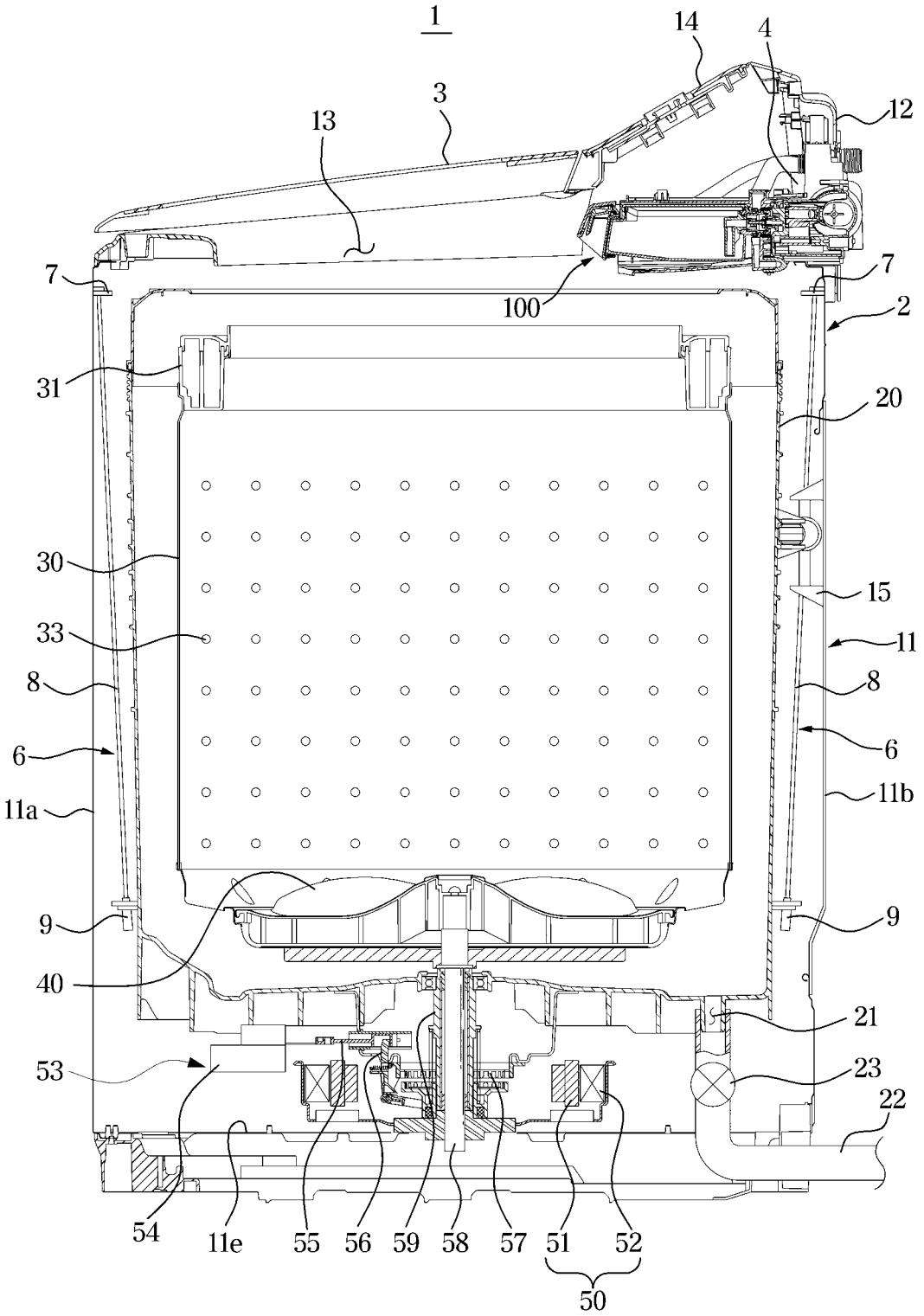
FIG. 2 is a side cross-sectional view of the clothing treatment apparatus shown in FIG. 1.

FIG. 1 is a perspective view showing a clothing treatment apparatus according to an embodiment of the present disclosure. FIG. 2 is a side cross-sectional view of the clothing treatment apparatus shown in FIG. 1.

Referring to FIGS. 1 and 2, a clothing treatment apparatus 1 according to an embodiment of the present disclosure may include a main body 2 forming an exterior thereof, a tub 20 provided within the main body 2 to store water, and a rotating tub 30 accommodating an object, such as an object to be washed or an object to be dried and rotatably provided within the tub 20, and a pulsator 40 rotatably provided inside the rotating tub 30 and generating a flow of washing water. The pulsator 40 may be shown as being provided at a lower portion of the rotating tub 30, but is not limited thereto.

The main body 2 may include a cabinet 11, and a top cover 12 coupled to an upper portion of the cabinet 11. The top cover 12 may be provided with an inlet 13 through which an object to be washed (i.e., laundry) may be placed in the rotating tub 30, and the inlet 13 may be opened and closed by a door 3. The top cover 12 may be provided with a control panel 14 that displays operating information of the clothing treatment apparatus 1 or receives operating instructions.

The cabinet 11 may have a box shape. In other words, the cabinet 11 may have a front plate 11*a*, a rear plate 11*b*, a left plate 11*c*, a right plate 11*d*, and a bottom plate 11*e*.

The tub 20 may be provided in a cylindrical shape with an open top and may store washing water. The tub 20 may be suspended from the cabinet 11 by suspension devices 6.

The suspension devices 6 may each include a suspension bar 8 extending vertically, a suspension cap 7 provided such that an upper end of the suspension bar 8 is coupled to the cabinet 11 and a lower end of the suspension bar 8 is coupled to the tub 20, and a spring 9 provided at the lower end of the suspension bar 8 to reduce vibration of the tub 20. The spring 9 may reduce the vibration of the tub 20 in a vertical direction.

A drain 21 may be formed in a lower portion of the tub 20 to drain the washing water stored in the tub 20 to the outside of the tub 20. A drain hose 22 may be connected to the drain 21, and a drain valve 23 may be provided on the drain hose 22 to open and close the drain 21.

The rotating tub 30 may be rotatably provided within the tub 20 and may accommodate laundry. The rotating tub 30 may be formed in a cylindrical shape with an open top. A plurality of holes 33 may be formed on a side surface of the rotating tub 30 to allow washing water to flow in and out. A balancing device 31 may be installed at an upper portion of the rotating tub 30 to eliminate a load imbalance caused by laundry. The balancing device 31 may include a housing having an annular channel and a ball or fluid mass movably provided within the channel. As the balls or fluid moves in accordance with the rotation of the rotating tub 30, the load imbalance may be resolved.

The pulsator 40 may be rotatably provided at the lower portion of the rotating tub 30 to generate a flow of washing water. Laundry may be washed by the flow of washing water generated by the pulsator 40.

The clothing treatment apparatus 1 may include a water supply device 4 that supplies washing water to the tub 20. The water supply device 4 may include a water supply pipe 170 connected to an external water supply source to guide washing water to the tub 20, and a water supply valve 15 (see FIG. 3) provided in the water supply pipe 170 to regulate the water supply.

The clothing treatment apparatus 1 may include a detergent supply device 100 that supplies detergent. The water supplied through the water supply device 4 may be provided to pass through the detergent supply device 100, so that the detergent may be supplied to the tub 20 together with the water. In this case, the detergent may include different detergents, such as rinse or softener for dryers as well as detergents for laundry.

The detergent supply device 100 may be provided above the tub 20. The detergent supply device 100 may be disposed on an upper side of the tub 20 to supply detergent into the tub 20 and/or the rotating tub 30. For example, the detergent supply device 100 may be provided on the top cover 12. In addition, the detergent supply device 100 may be disposed on a rear side of the top cover 12. The detergent supply device 100 may be pulled out towards the inlet 13 or may be pulled into the top cover 12 from the inlet 13.

The clothing treatment apparatus 1 may include a drive device for rotating the rotating tub 30 and the pulsator 40.

The drive device may include a motor 50 that converts an electrical force into a mechanical rotational force, and a shaft system that transmits a driving force of the motor 50 to the pulsator 40 and the rotating tub 30.

The motor 50 may include a fixed stator 51 and a rotor 52 that interacts electromagnetically with the stator 51 to rotate.

The shaft system may include a spin-drying shaft 59 provided to transmit the driving force of the motor 50 to the rotating tub 30, a washing shaft 58 provided to transmit the driving force of the motor 50 to the pulsator 40, and a clutch device 53 that connects or disconnects the motor 50 and the spin-drying shaft 59.

The spin-drying shaft 59 may be formed to have a hollow, and the washing shaft 58 may be provided in the hollow of the spin-drying shaft 59. The washing shaft 58 may remain connected to the rotor 52 of the motor 50, and the spin-drying shaft 59 may be connected to or disconnected from the rotor 52 of the motor 50 by the clutch device 53.

When the clutch device 53 disconnects the spin-drying shaft 59 from the motor 50, power may be transmitted only to the washing shaft 58 to allow only the pulsator 40 to rotate, and when the clutch device 53 connects the spin-drying shaft 59 to the motor 50, power may be transmitted to both the spin-drying shaft 59 and the washing shaft 58 to allow the rotating tub 30 and the pulsator 40 to rotate simultaneously.

When the pulsator 40 rotates only, the washing water flow may be generated by the rotation of the pulsator 40, and the laundry may be rotated by the generated washing water flow and rubbed against the rotating tub 30, thereby performing washing of the laundry. When the pulsator 40 and the rotating tub 30 rotate together, the laundry may rotate in the rotating tub 30, and moisture is removed from the laundry by a centrifugal force, thereby performing spin-drying of the laundry.

The clutch device 53 may include an actuator 54 that generates a driving force for power conversion, a rod 55 that is moved linearly by an action of the actuator 54, a lever 56 that is pivotally connected to the rod 55, and a coupling 57 coupled to the spin-drying shaft 59 to be move vertically in accordance with an operation of the lever 56. When the coupling 57 is lowered, the coupling 57 may be connected to the rotor 52 so that the driving force of the motor 50 may be transmitted to the spin-drying shaft 59, and when the coupling 57 is raised, the coupling 57 may be disconnected from the rotor 52 so that the driving force of the motor 50 may be not transmitted to the spin-drying shaft 59.

Figure 3:
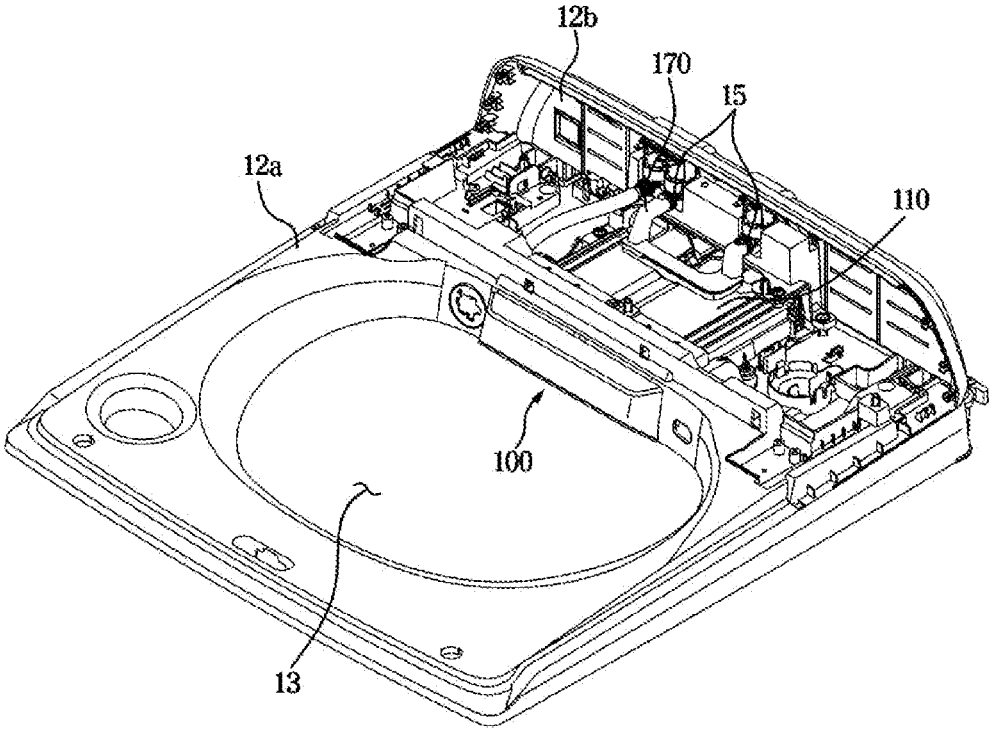
FIG. 3 is a perspective view showing an upper portion of the clothing treatment apparatus shown in FIG. 1.
Figure 4:
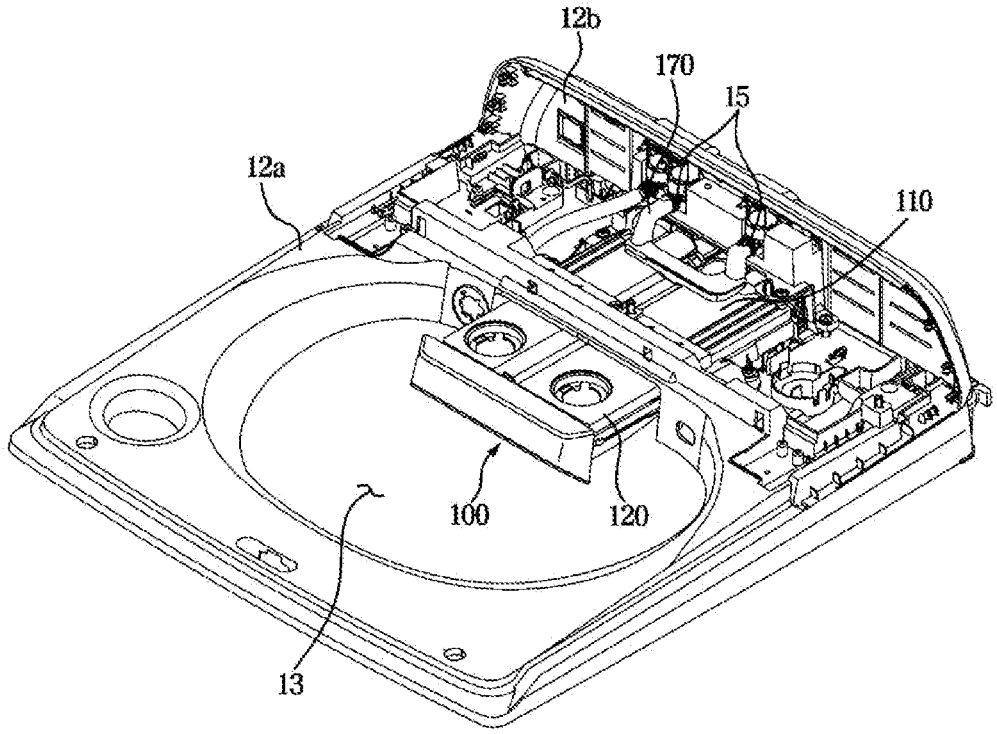
FIG. 4 is a perspective view showing the upper portion of the clothing treatment apparatus shown in FIG. 1.

FIGS. 3 and 4 are perspective views showing the upper portion of the clothing treatment apparatus shown in FIG. 1.

Referring to FIGS. 3 and 4, the clothing treatment apparatus 1 according to an embodiment of the present disclosure may include the detergent supply device 100.

The detergent supply device 100 may be provided within the main body 2. For example, the detergent supply device 100 may be provided on the top cover 12 to supply detergent and water into the tub 20 and/or the rotating tub 30. The detergent supply device 100 may be provided on a rear portion 12*b* of the top cover 12. An upper portion of the detergent supply device 100 may be covered by an upper cover of the top cover 12.

To be supplied with water from a water supply source, the detergent supply device 100 may be connected to a water supply member and a water supply valve 15 that opens or closes the water supply member. The water supply valve 15 may be coupled to the top cover 12.

The detergent supply device 100 may be positioned above the tub 20. Referring to FIG. 4, a detergent container 120 may be pulled out from the main body 2 towards the inlet 13. For example, the detergent container 120 may be pulled out from the rear portion 12*b* of the top cover 12 toward the inlet 13 and/or a front portion 12*a* of the top cover 12. In addition, referring to FIG. 3, the detergent container 120 may be pulled into the inside of the top cover 12 from the inlet 13. For example, the detergent container 120 may be drawn out or into towards the top cover 12 in a front-to-back direction.

The detergent supply device 100 may include a housing 110 and the water supply pipe 170 in communication with the housing 110. The water supply pipe 170 may form a flow path so that water supplied to the detergent supply device 100 flows into the housing 110. The interior of the housing 110 may be a water receiving space 111. The water supply pipe 170 may be supplied with hot water and/or cold water from the water supply member. The water supply pipe 170 may be disposed above the housing 110. However, the water supply pipe 170 is not limited thereto, and may be disposed on a laterally or underside of the housing 110 to supply water into the housing 110.

Figure 5:
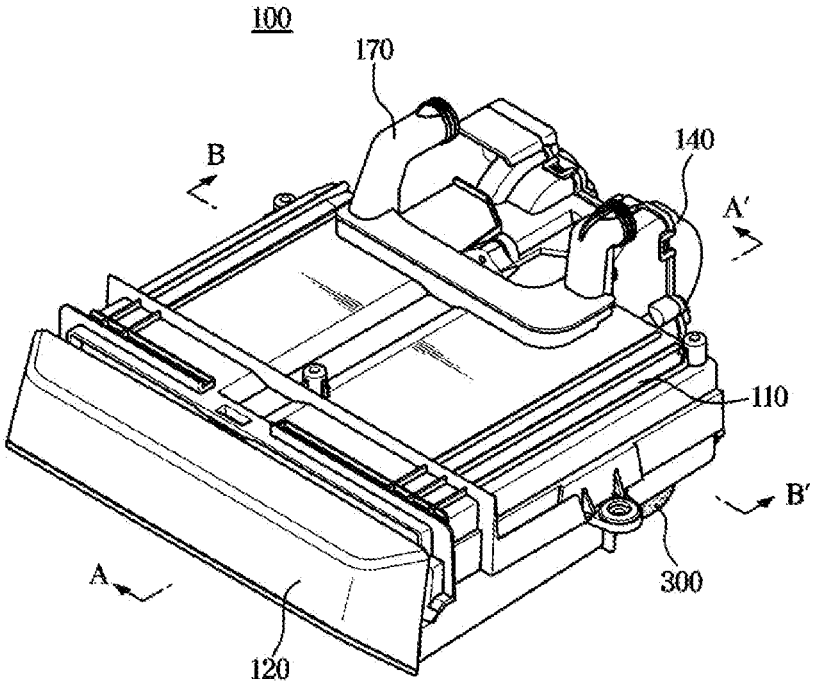
FIG. 5 is a perspective view showing a detergent supply device in the clothing treatment apparatus shown in FIG. 1.
Figure 6:
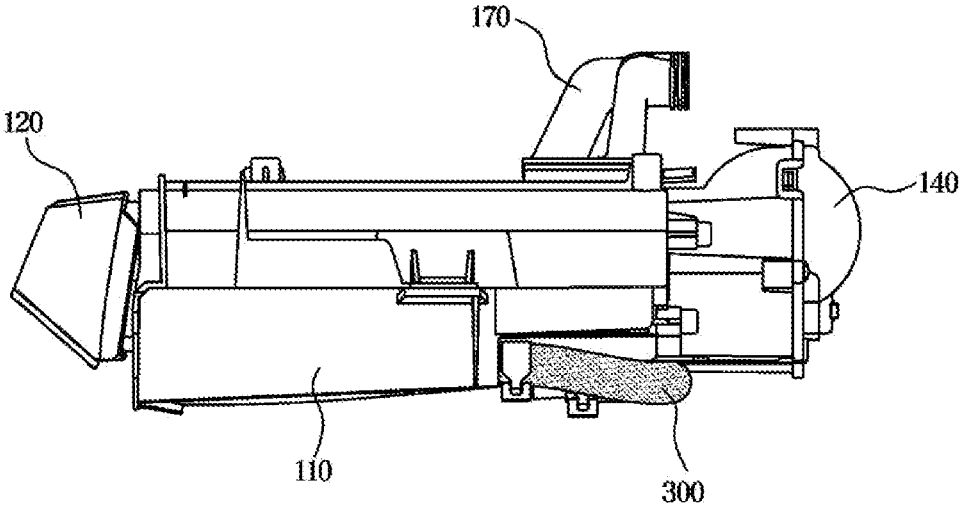
FIG. 6 is a side view of the detergent supply device shown in FIG. 5.
Figure 7:
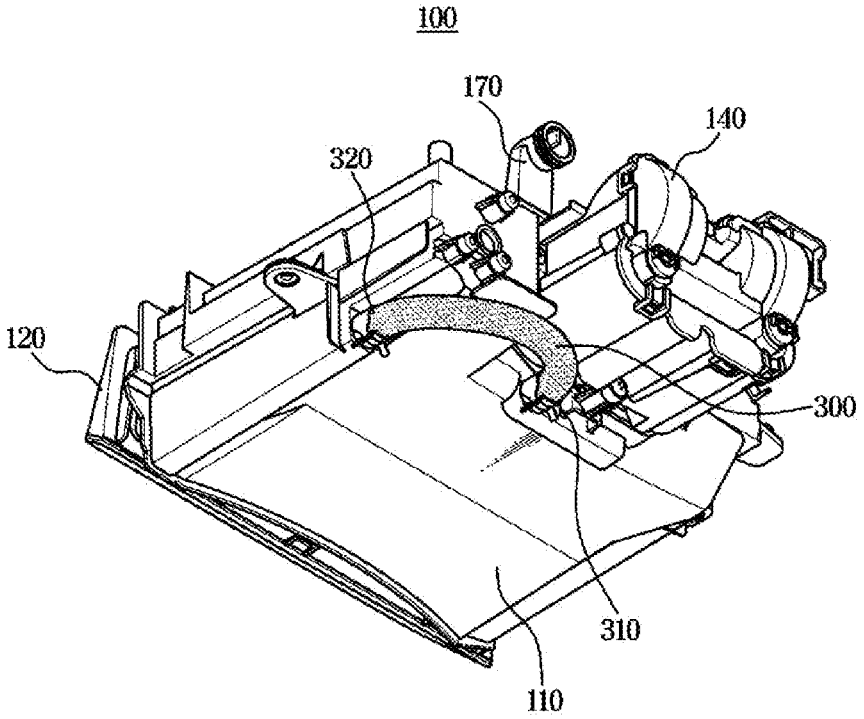
FIG. 7 is a rear perspective view of the detergent supply device shown in FIG. 5.

FIG. 5 is a perspective view showing the detergent supply device in the clothing treatment apparatus shown in FIG. 1, FIG. 6 is a side view of the detergent supply device shown in FIG. 5, and FIG. 7 is a perspective view of the detergent supply device shown in FIG. 5 as seen from behind.

The detergent supply device 100 may include the housing 110, the detergent container 120, a detergent pump 140, the water supply pipe 170, and a connection tube 300.

The detergent container 120 may be received in the housing 110. The detergent container 120 may be arranged to be separable from the housing 110. The water supply pipe 170 may be in communication with the housing 110 and may be provided on an upper portion of the housing 110. The detergent pump 140 may be coupled to a rear side of the housing 110.

The connection tube 300 may communicate with the housing 110. The connection tube 300 may be connected to the rear side of the housing 110. Referring to FIG. 7, the connection tube 300 may include a connection tube inlet 310 and a connection tube outlet 320. The connection tube outlet 320 may be located at a position higher than that of the connection tube inlet 310. This will be described later.

Figure 8:
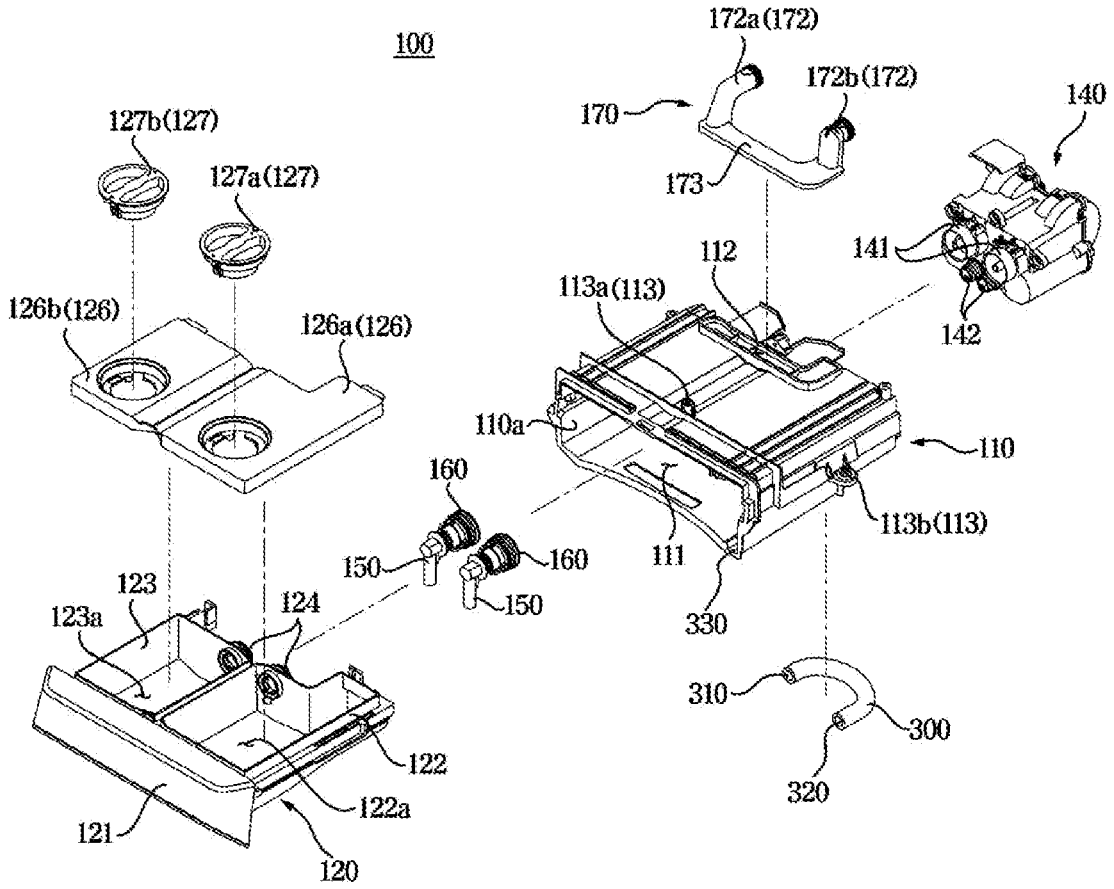
FIG. 8 is an exploded perspective view showing the detergent supply device shown in FIG. 5.
Figure 9:
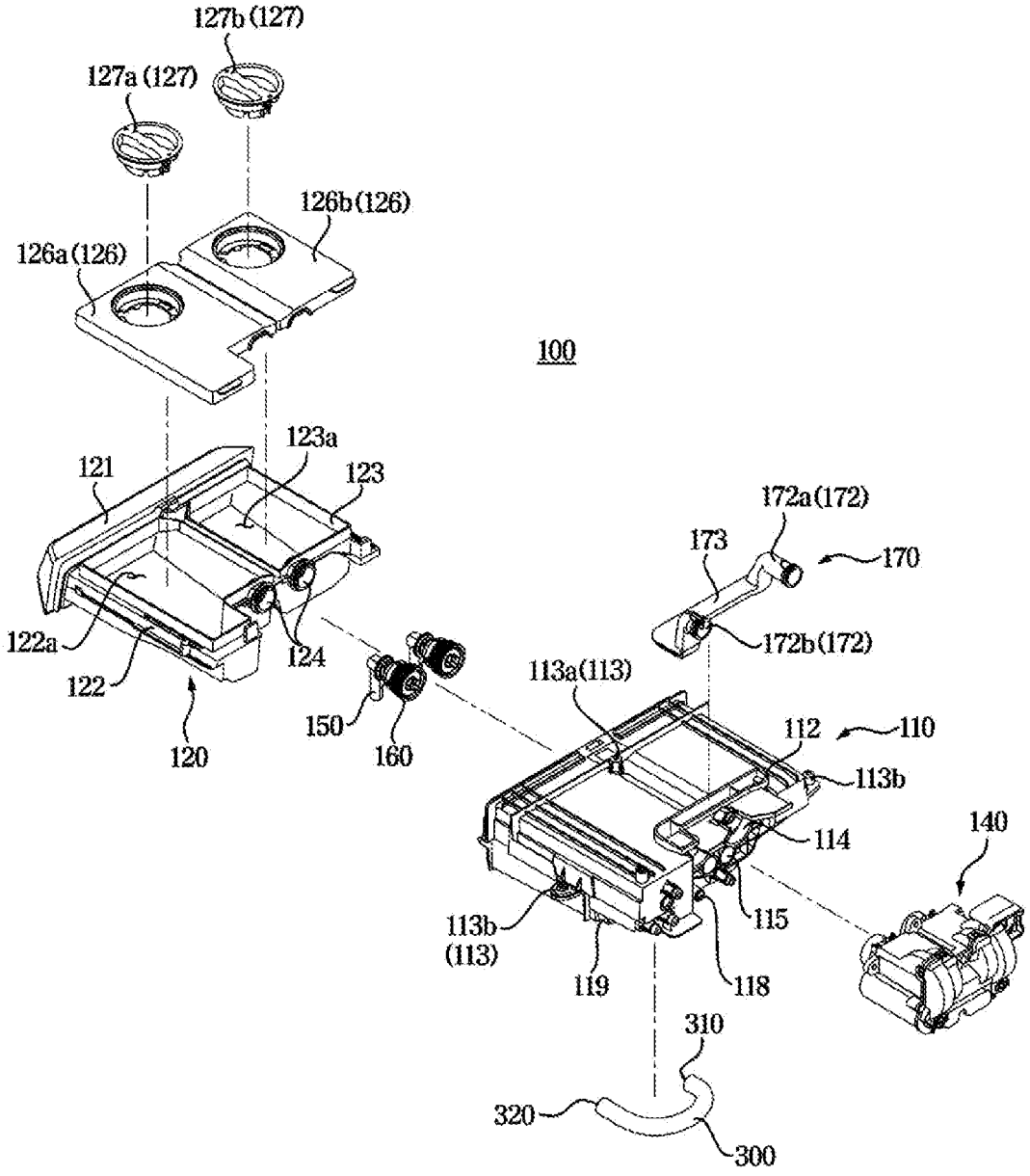
FIG. 9 is an exploded perspective view showing the detergent supply device shown in FIG. 5.
Figure 10:
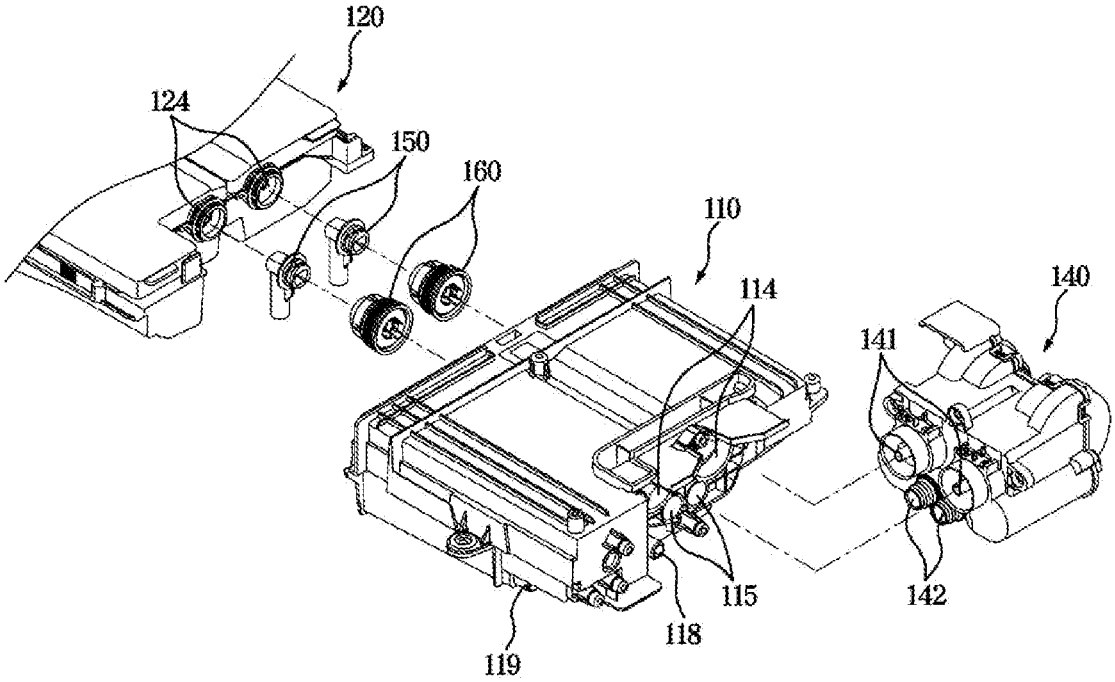
FIG. 10 is a view showing a coupling relationship between a detergent container, a pipe, a valve, a housing, and a detergent pump in the detergent supply device shown in FIG. 5.

FIGS. 8 and 9 are exploded perspective views showing the detergent supply device shown in FIG. 5. FIG. 10 is a view showing a coupling relationship between the detergent container, tube, valve, housing, and detergent pump in the detergent supply device shown in FIG. 5.

The housing 110 may include an opening 110*a*, a receiving space 111, a water supply hole 112, a housing outlet hole 114, and a housing inlet hole 115.

The opening 110*a* of the housing 110 may be formed in a front portion of the housing 110. The detergent container 120 may be pulled out from the receiving space 111 toward the inlet 13 through the opening 110*a*, or may be pulled in from the inlet 13 toward the receiving space 111.

The receiving space 111 may receive the detergent container 120 in the housing 110. The receiving space 111 may be formed by walls of the housing 110. For example, the receiving space 111 may be formed by a top wall, side walls, and a bottom wall of the housing 110. In addition, the receiving space 111 may also be covered by a rear wall 200 of the housing 110.

The housing 110 may accommodate the detergent container 120. For example, the housing 110 may accommodate a first detergent container 122, a second detergent container 123, and a detergent container cover 126. The detergent container 120 may be placed in the receiving space 111 of the housing 110.

The housing 110 may be in communication with the water supply pipe 170 that supplies water from an external water supply source. The housing 110 may include the water supply hole 112 that communicates with the water supply pipe 170. The water supply hole 112 may be formed on one wall of the housing 110. For example, the water supply hole 112 may extend upwardly from the top wall of the housing 110. However, the present disclosure is not limited thereto, and the water supply hole 112 may extend from the side wall or bottom wall of the housing 110 and may also extend from the rear wall 200. The water supply hole 112 may be formed to correspond to the water supply pipe 170.

A top cover fixing portion 113 may secure the detergent supply device 100 to the top cover 12. For example, the top cover fixing portion 113 may allow the housing 110 to be secured to the top cover 12. The top cover fixing portion 113 may include a first fixing portion 113*a* and a second fixing portion 113*b*. The first fixing portion 113*a* may protrude upwardly from the top wall of the housing 110. The second fixing portion 113*b* may protrude laterally from the side wall of the housing 110. The number and/or shape of the top cover fixing portions 113 may not be limited to those shown in the drawings.

Referring to FIG. 9, when the detergent container 120 is docked with the detergent pump 140, the housing outlet hole 114 may be configured to allow the detergent in the detergent container 120 to be drawn into the detergent pump 140 to move out of the housing 110. The housing inlet hole 115 may be configured to allow the detergent drawn into the detergent pump 140 to flow back into the receiving space 111 within the housing 110. In other words, the detergent in the detergent container 120 may move between the housing 110 and the detergent pump 140 using the housing outlet hole 114 and the housing inlet hole 115 as passages.

The housing outlet hole 114 and/or the housing inlet hole 115 may be formed in a rear portion of the housing 110. For example, the housing outlet hole 114 and/or the housing inlet hole 115 may be formed to penetrate the rear wall 200 of the housing 110. The housing inlet hole 115 may be provided at a position lower than that of the housing outlet hole 114. The housing outlet hole 114 and the housing inlet hole 115 may be provided in a plurality.

The housing 110 may include a washing water inlet hole 119 and a washing water outlet hole 118. The washing water inlet hole 119 and/or the washing water outlet hole 118 may be formed to penetrate the rear wall 200 of the housing 110. The washing water inlet hole 119 and the washing water outlet hole 118 may be connected by the connection tube 300. The washing water inlet hole 119 and the washing water outlet hole 118 may be connected to the connection tube outlet 320 and the connection tube inlet 310 of the connection tube 300, respectively. Water entering the housing 110 through the water supply pipe 170 may flow to the washing water outlet hole 118. The water that has flowed to the washing water outlet hole 118 may flow to the connection tube 300 provided outside the housing 110. The water that has flowed through the connection tube 300 may flow through the washing water inlet hole 119 and again flow to the receiving space 111 within the housing 110. In other words, the receiving space 111 may also receive water. The water entering the receiving space 111 through the washing water inlet hole 119 may flow through a lower portion of the housing 110 and flow into the tub 20 and/or the rotating tub 30.

Referring to FIG. 8, the housing 110 may include a guide channel 330 for guiding detergent and/or water flowing in from the washing water inlet hole 119 to the tub 20. The guide channel 330 may be provided elongating from the washing water inlet hole 119 to the opening 110*a* of the housing 110. The guide channel 330 may be provided at a bottom of the housing 110. In the present drawings, the guide channel 330 is shown as an example formed by a rib-shaped partition elongating on the bottom of the housing 110, but the present disclosure is not limited thereto. For example, the guide channel 330 may be concavely recessed downwardly from the bottom of the housing 110.

The rear wall 200 of the housing 110 may be coupled with a sensor capable of detecting whether the detergent container 120 is received within the housing 110 or whether the detergent container 120 is docked with the detergent pump 140.

The detergent container 120 may be inserted into the receiving space 111 through the opening 110*a* of the housing 110 or may be removed towards the inlet 13. The detergent container 120 may store a main wash detergent (e.g., powder or liquid detergent), a pre-wash detergent, a fabric softener, and/or a bleach.

The detergent container 120 may include a front cover 121, the first detergent container 122, the second detergent container 123, a pump connector 124, the detergent container cover 126, and a cap 127.

The front cover 121 may be disposed on a front side among the components of the detergent container 120. The front cover 121 may form a portion of the inlet 13. The front cover 121 may have a grip portion formed therein so that a user may insert into or remove from the detergent container 120 by holding the detergent container 120.

The first detergent container 122 and/or the second detergent container 123 may contain a main wash detergent, a fabric softener, and/or a rinse agent. For example, the first detergent container 122 may contain a main wash detergent, and the second detergent container 123 may contain a fabric softener or a pre-wash detergent. The first detergent container 122 may be formed larger than the second detergent container 123. However, the type of detergent contained and/or the size of the detergent containers 122 and 123 are not limited to the above examples. The first detergent container 122 and the second detergent container 123 may be disposed on a rear side of the front cover 121. The first detergent container 122 may form a first region 122*a* and the second detergent container 123 may form a second region 123*a*. For example, a main wash detergent may be received in the first region 122*a*, and a fabric softener or a pre-wash detergent may be received in the second region 123*a*.

The detergent container cover 126 may be configured to cover upper portions of the detergent containers 122 and 123. For example, the detergent container cover 126 may be configured to cover upper ends of the detergent containers 122 and 123. The detergent container cover 126 may include a first detergent container cover 126*a*, which corresponds to the first region 122*a* and is configured to cover the upper portion of the first detergent container 122, and a second detergent container cover 126*b*, which corresponds to the second region 123*a* and is configured to cover the upper portion of the second detergent container 123.

The cap 127 may be coupled to the detergent container cover 126. The cap 127 may be removed when the user places detergent in the detergent container. When the user has finished adding detergent to the detergent container, the cap 127 may be refitted to the detergent container cover 126. The cap 127 may include a first cap 127*a* and a second cap 127*b*. The first cap 127*a* may be fitted to the first detergent container cover 126*a*, and the second cap 127*b* may be fitted to the second detergent container cover 126*b*.

Referring to FIG. 10, the pump connector 124 may be formed in the detergent container 120. A plurality of pump connectors 124 may be provided. A pump connecting portion (e.g., a pipe 150, a valve 160) may be coupled to the pump connector 124. The pump connector 124 may allow detergent received in the detergent container 120 to move to the detergent pump 140 through the pipe 150 and the valve 160. The pump connector 124 may be connected to the housing outlet hole 114. For example, when the detergent container 120 and the detergent pump 140 are docked, the detergent in the detergent container 120 may be moved to the detergent pump 140 through the pump connector 124 and the housing outlet hole 114 and then back into the interior of the housing 110 through the housing inlet hole 115. However, the location of the pump connector 124 is not limited to what is shown in the drawings.

The detergent pump 140 may be disposed on the rear side of the housing 110 and the detergent container 120. The detergent pump 140 may be fixed to the housing 110. When the detergent container 120 is inserted into and docked with the housing 110, the detergent pump 140 may draw in the detergent in the detergent container 120 and discharge the drawn in detergent into the receiving space 111 in the housing 110. The detergent pump 140 may include a pump inlet 141 that draws in detergent, and a pump outlet 142 that dispenses detergent. For example, when the pump connector 124 of the detergent container 120 is docked with the pump inlet 141 of the detergent pump 140, the detergent received in the detergent container 120 may flow into the detergent pump 140 through the pump connector 124 and the housing outlet hole 114 and the pump inlet 141, and then into the housing 110 through the pump outlet 142 and the housing inlet hole 115. The detergent flowing into the housing 110 may be mixed with water entering the housing 110 through the water supply pipe 170. The water mixed with the detergent may flow along the lower wall of the housing 110, which is formed to be inclined forwardly and downwardly, into the tub 20 and/or the rotating tub 30.

The pump connecting component coupled to the pump connector 124 may include the pipe 150 and the valve 160.

The pipe 150 may communicate the detergent container 120 and the detergent pump 140. The pipe 150 may be disposed within the detergent container 120. For example, the pipe 150 may be disposed in the first region 122*a* or the second region 123*a*. The detergent may flow to the detergent pump 140 through the pipe 150. That is, the detergent may flow to the detergent pump 140 through a detergent flow path formed in the pipe 150.

The valve 160 may open and close the detergent flow path. The valve 160 may open and close the detergent flow path to regulate an amount of detergent flowing to the detergent pump 140. The valve 160 may be disposed between the detergent container 120 and the detergent pump 140. For example, the valve 160 may be positioned between the detergent container 120 and the detergent pump 140 along the front-to-back direction.

Referring to FIGS. 8 and 9, the water supply pipe 170 may guide water entering the tub 20 from the outside of the clothing treatment apparatus through the water supply member. The water supply pipe 170 may be disposed on an upper side of the housing 110 to communicate with the water supply hole 112. However, the location of the water supply pipe 170 is not limited to the above example. The water supply pipe 170 and the housing 110 may be thermally bonded.

The water supply pipe 170 may include a pipe portion 172 and a panel portion 173. The pipe portion 172 may be provided on an upper side of the panel portion 173. The pipe portion 172 may be connected to the water supply valve 15. The pipe portion 172 may receive water from the outside of the clothing treatment apparatus 1 through the water supply member and the water supply valve 15 and supply the received water to the interior of the housing 110. The pipe portion 172 may be connected to the panel portion 173.

The pipe portion 172 may include a first pipe portion 172*a* and a second pipe portion 172*b*. For example, the first pipe portion 172*a* may be disposed further forward than the second pipe portion 172*b*. In addition, for example, the first pipe portion 172*a* may be disposed further to the right of the second pipe portion 172*b*. In addition, for example, the first pipe portion 172*a* may be supplied with cold water and the second pipe portion 172*b* may be supplied with hot water. However, the location, shape, and type of hot and cold water of the first pipe portion 172*a* and the second pipe portion 172*b* are not limited to the above examples.

The panel portion 173 may be disposed on a lower portion of the pipe portion 172. The panel portion 173 may communicate with the water supply hole 112 of the housing 110.

Referring to FIG. 9, the connection tube 300 may connect the washing water outlet hole 118 and the washing water inlet hole 119 formed on the rear wall 200 of the housing 110. That is, the connection tube 300 may be configured to allow water discharged from the housing 110 through the washing water outlet hole 118 to flow back into the housing 110 through the washing water inlet hole 119.

Figure 11:
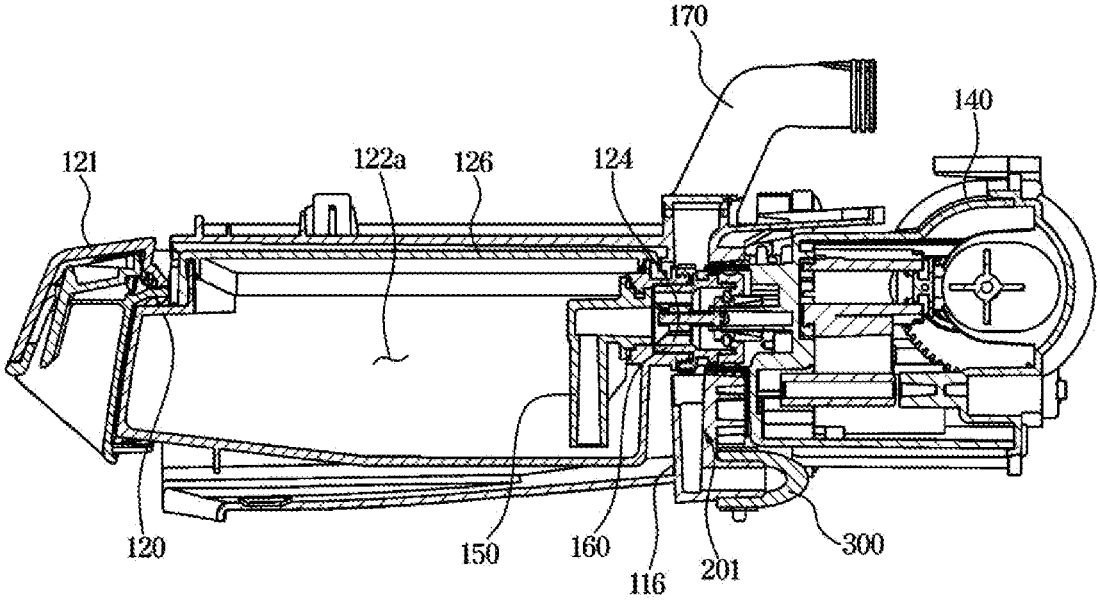
FIG. 11 is a cross-sectional view of the detergent supply device shown in FIG. 5.
Figure 12:
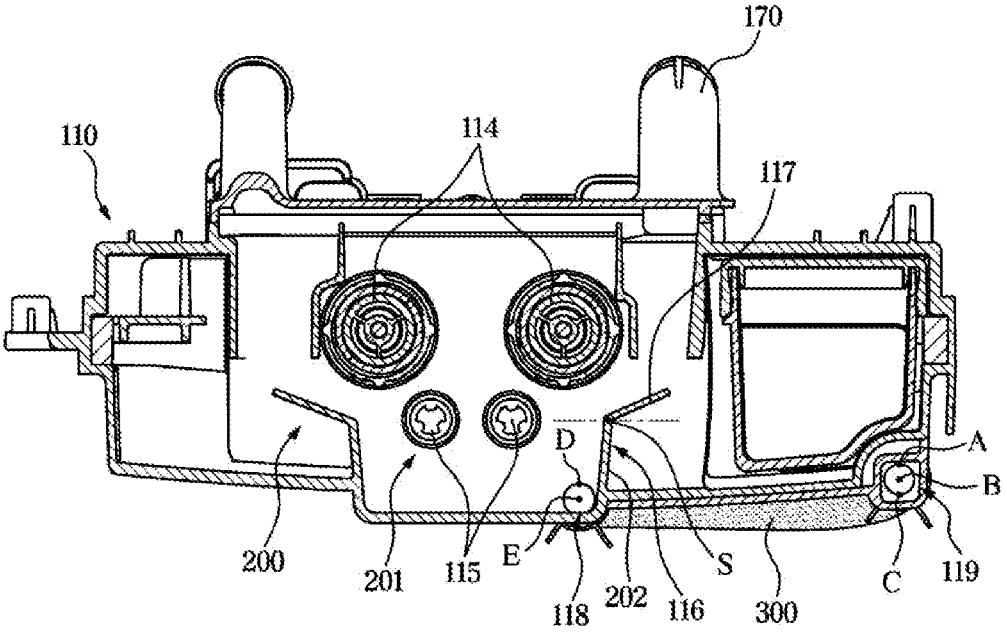
FIG. 12 is a front cross-sectional view of the detergent supply device shown in FIG. 5.
Figure 13:
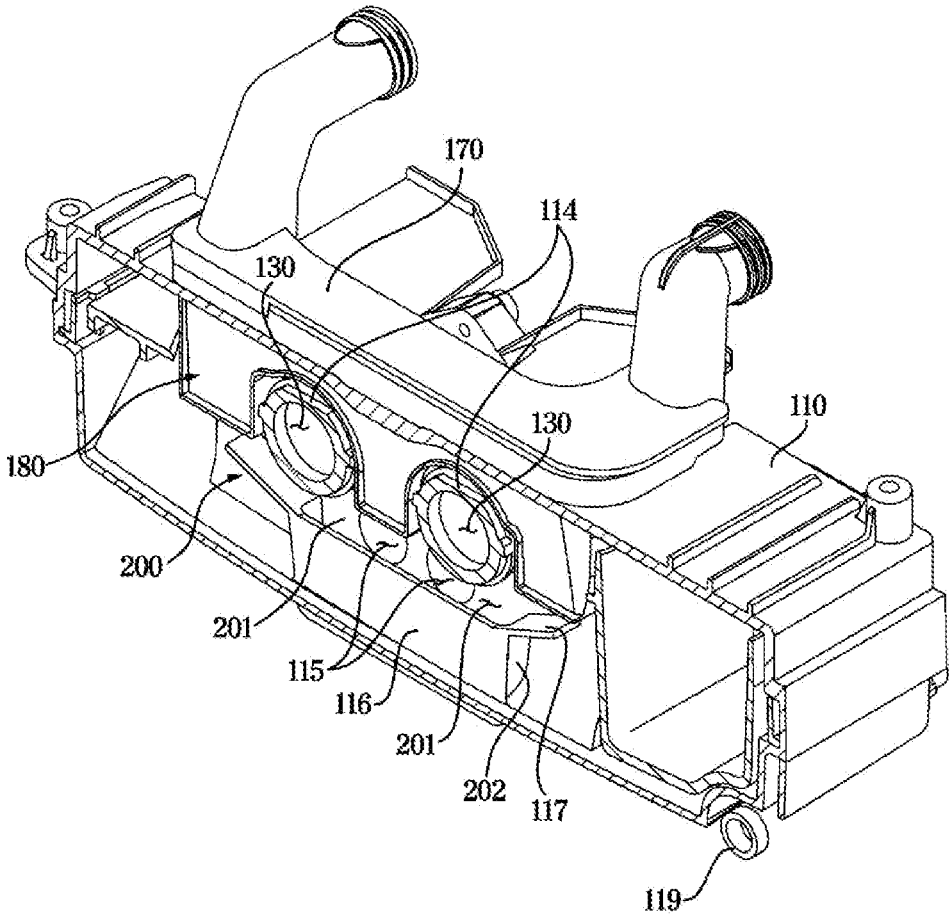
FIG. 13 is a view showing the detergent supply device shown in FIG. 5.

FIG. 11 is a cross-sectional view of the detergent supply device shown in FIG. 5. FIG. 12 is a front cross-sectional view of the detergent supply device shown in FIG. 5, and FIG. 13 is a view showing the detergent supply device shown in FIG. 5.

The detergent in the detergent container 120 may be supplied into the housing 110 by action of the detergent pump 140. More specifically, the detergent in the detergent container 120 may be drawn into the pipe 150 connected to the detergent container 120 and moved to the pump connector 124. Thereafter, the detergent in the detergent container 120 may be moved to the pump inlet 141 coupled with the pump connector 124 and the valve 160. That is, the detergent in the detergent container 120 may be moved through the housing outlet hole 114 to the detergent pump 140.

After being moved to the detergent pump 140, the detergent may be moved to the pump outlet 142 and supplied into the housing 110. In other words, the detergent that has moved to the pump outlet 142 may be supplied into the housing 110 through the housing inlet hole 115. More specifically, the detergent may be supplied to a storage bin 116 within the housing 110.

In other words, the detergent supply device 1 may include a detergent flow path through which the detergent in the detergent container 120 moves to the storage bin 116 in the housing 110. The storage bin 116 may store the detergent that has been introduced into the housing inlet hole 115 through the detergent flow path.

The storage bin 116 may receive detergent remaining in the pump connector 124 of the detergent container 120, the valve 160, and the housing inlet hole 115 of the housing 110. In particular, when the detergent container 120 is undocked from the housing 110, the storage bin 116 may accommodate detergent that has leaked into the housing 110 from the pump connector 124 of the detergent container 120, the valve 160, and the housing outlet hole 114 of the housing 110.

The housing 110 may be in communication with the water supply pipe 170, and the water supplied from the water supply pipe 170 may flow into the housing 110. The water may be supplied to the storage bin 116 within the housing 110.

The housing 110 may be in communication with the connection tube 300. The detergent and/or water received in the storage bin 116 may be moved to the connection tube 300 through the washing water outlet hole 118 (the connection tube inlet 310). The detergent and/or water moving to the connection tube 300 may be introduced into the housing 110 through the washing water inlet hole 119 (the connection tube outlet 320).

The connection tube 300 may receive detergent and/or water. The connection tube 300 may include the connection tube inlet 310 and the connection tube outlet 320 communicated with the housing 110, and may form a passage of detergent and/or water from the connection tube inlet 310 to the connection tube outlet 320.

At the time of water supply of the clothing treatment apparatus 1, water may be supplied to the storage bin 116 through the water supply pipe 170, and the water in the storage bin 116 may flow through the washing water outlet hole 118 of the housing 110 into the connection tube inlet 310.

In operation of the detergent supply device 100, detergent may be supplied to the storage bin 116 by the detergent pump 140, and the detergent in the storage bin 116 may be introduced into the connection tube inlet 310 through the washing water outlet hole 118 of the housing 110.

The detergent and/or water in the connection tube 300 may move to the connection tube outlet 320 and into the housing 110 through the washing water inlet hole 119 of the housing 110.

In the event that the water supply to the clothing treatment apparatus 1 is interrupted, water may be stored in the connection tube 300 up to a level equal to the level of water stored in the storage bin 116. That is, the connection tube 300 may store residual water (also referred to as remaining water) outside the housing 110.

When the detergent container 120 is separated from the housing 110, the detergent in the detergent container 120 may leak into the receiving space 111 inside the housing 110. More particularly, detergent remaining in the pump connector 124 of the detergent container 120, the pump connecting component (the pipe 150, the valve 160), and the housing outlet hole 114 may leak to the bottom of the housing 110. The detergent that leaks into the housing 110 may be received in the storage bin 116. When the leaked detergent is supplied to the storage bin 116, the detergent in the storage bin 116 may be introduced to the connection tube inlet 310 through the washing water outlet hole 118 of the housing 110. That is, the connection tube 300 may store residual detergent (also referred to as remaining detergent) outside of the housing 110.

The connection tube 300 may store residual water and/or residual detergent. The connection tube 300 storing residual water may further accommodate residual detergent newly introduced from the connection tube inlet 310. The residual water and residual detergent in the connection tube 300 may be accommodated within the connection tube 300 until the level of the residual water and residual detergent in the storage bin 116 is equal to the height of the connection tube outlet 320. Then, when the level of water and/or detergent in the storage bin 116 becomes higher than the height of the connection tube outlet 320 due to the water supply, the residual water and/or residual detergent in the connection tube 300 may be introduced through the connection tube outlet 320 into the washing water inlet hole 119 of the housing 110 and moved into the housing 110.

The housing 110 of the detergent supply device 100 may include the storage bin 116, a water collection guide 117, and a flow guide 180.

The storage bin 116 may be provided in the receiving space 111 of the housing 110. The storage bin 116 may be provided below the flow guide 180. The storage bin 116 may be configured to collect water guided into the housing 110 through the water supply pipe 170 and the flow guide 180. In addition, the storage bin 116 may collect the detergent that has passed through the detergent container 120 and the detergent pump 140 into the housing 110. The detergent and water may be mixed together in the storage bin 116.

The housing 110 may include the rear wall 200 disposed on a rear side of the detergent container 120. The rear wall 200 of the housing 110 may include a blocking portion 201 that defines one side of the storage bin 116. The storage bin 116 may include the blocking portion 201. The storage bin 116 may include a partition wall 202 extending forwardly from the rear wall 200 of the housing 110. A storage space within the storage bin 116 may be surrounded by the blocking portion 201 and the partition wall 202.

Although the present disclosure illustrates as an example that the storage bin 116 includes the partition wall 202 extending upwardly from the bottom of the housing 110, the present disclosure is not limited thereto. For example, the storage bin 116 may be formed to be spaced apart from the bottom of the housing 110. Alternatively, the storage bin 116 may have a concave shape, i.e., be recessed from the bottom of the housing 110.

The storage bin 116 may be in communication with the washing water outlet hole 118. That is, the blocking portion 201 may be in communicate with the washing water outlet hole 118. Accordingly, the water and/or detergent in the storage bin 116 may flow to the outside of the housing 110 through the washing water outlet hole 118 of the blocking portion 201 and the connection tube 300, and then flow back into the receiving space 111, which is the inside of the housing 110, through the washing water inlet hole 119. The water and/or detergent may then flow along the lower wall of the housing 110, which is formed to be inclined forwardly and downwardly, into the tub 20 and/or the rotating tub 30.

The water collection guide 117 may be provided at the upper portion of the storage bin 116. The water collection guide 117 may guide a flow of water such that the water from the water supply pipe 170 is collected in the storage bin 116. The water collection guide 117 may be connected to the storage bin 116. The water collection guide 117 may be inclined downward toward the storage bin 116. The water collection guides 117 may be provided on opposite sides of the storage bin 116.

Figure 14:
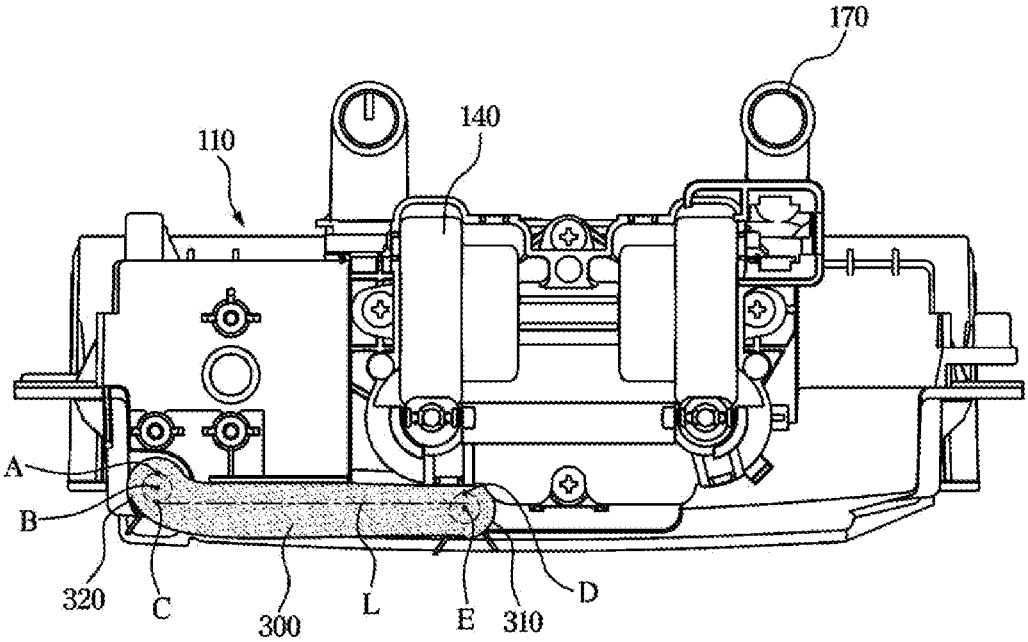
FIG. 14 is a rear view showing the detergent supply device shown in FIG. 5.
Figure 15:
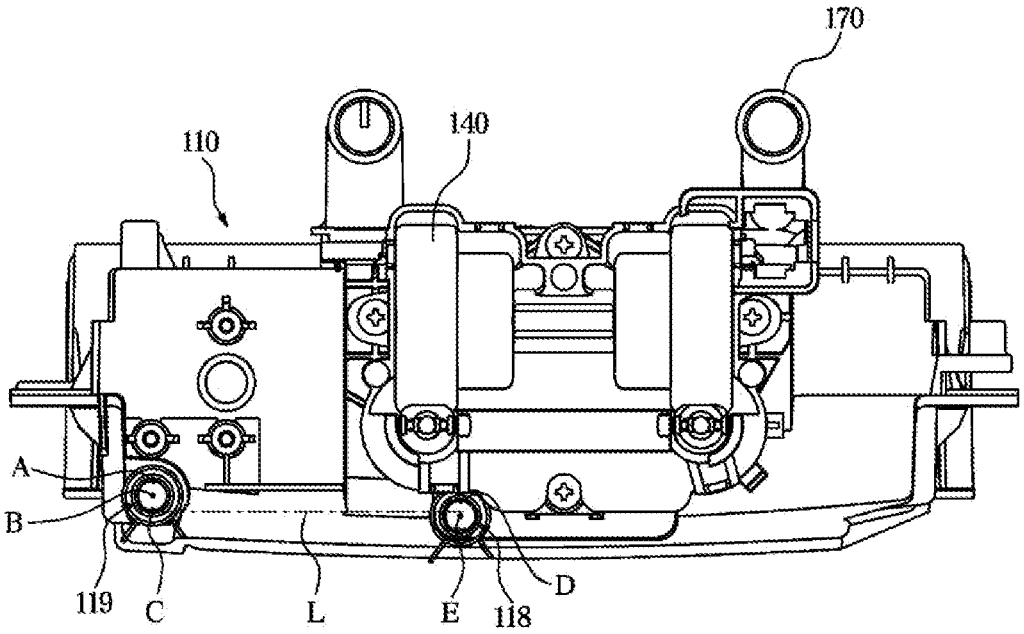
FIG. 15 is a rear view with a connection tube removed from the detergent supply device shown in FIG. 5.

FIG. 14 is a view showing the detergent supply device shown in FIG. 5 as seen from behind. FIG. 15 is a view showing the detergent supply device with the connection tube removed shown in FIG. 5 as seen from behind.

Referring to FIG. 14, the connection tube 300 may be bent in a U shape. The connection tube 300 may be provided in the rear wall 200 of the housing 110 and may be in communicate with the rear wall 200 of the housing 110.

The connection tube outlet 320 may be provided at a position higher than that of the connection tube inlet 310. In particular, a center B of the connection tube outlet 320 may be provided at a position higher than that of a center E of the connection tube inlet 310. In addition, a lower end C of the connection tube outlet 320 may be provided at a position higher than that of the center E of the connection tube inlet 310. That is, based on a virtual straight line L extending from the lower end C of the connection tube outlet 320, the center E of the connection tube inlet 310 may be located below the virtual straight line L. Although the present disclosure illustrates an example in which the lower end C of the connection tube outlet 320 is provided at a lower position than an upper end D of the connection tube inlet 310, the present disclosure is not limited thereto. For example, the lower end C of the connection tube outlet 320 may be provided at a higher position than the upper end D of the connection tube inlet 310.

As a result, the detergent and/or water received in the connection tube 300 may be prevented from flowing into the housing 110 through the connection tube outlet 320. That is, if the connection tube 300 is not fully filled with detergent and/or water, the detergent and/or water may be prevented from flowing into the housing 110 through the connection tube outlet 320, thereby storing the detergent and/or water in the connection tube 300.

Referring to FIG. 15, the housing 110 may include the washing water outlet hole 118 and the washing water inlet hole 119 to allow the connection tube 300 to be communicated. The washing water outlet hole 118 may be connected to the connection tube inlet 310, and the washing water inlet hole 119 may be connected to the connection tube outlet 320. The washing water inlet hole 119 may be provided at a position higher than that of the washing water outlet hole 118. In particular, the center B of the washing water inlet hole 119 may be provided at a position higher than that of the center E of the washing water outlet hole 118. In addition, the lower end C of the washing water inlet hole 119 may be provided at a position higher than that of the center E of the washing water outlet hole 118. That is, based on the virtual straight line L extending from the lower end C of the washing water inlet hole 119, the center E of the washing water outlet hole 118 may be located below the virtual straight line L. Although the present disclosure illustrates an example in which the lower end C of the washing water inlet hole 119 is provided at a lower position than the upper end D of the washing water outlet hole 118, the present disclosure is not limited thereto. For example, the lower end C of the washing water inlet hole 119 may be provided at a higher position than the upper end D of the washing water outlet hole 118.

Referring to FIG. 12, the washing water inlet hole 119 may be provided at a lower level than the maximum level of water and/or detergent that the storage bin 116 may accommodate. That is, an upper end A of the washing water inlet hole 119 may be provided at a lower level than an upper end S of the storage bin 116, which is the maximum level of water and/or detergent that the storage bin 116 may accommodate. The washing water inlet hole 119 may be provided at a lower level than the housing inlet hole 115.

The combined volume of the connection tube 300 and the storage bin 116 may be equal to or greater than the maximum amount of detergent that may leak from the detergent supply device 100. In other words, the volume of detergent that may be accommodated by the connection tube 300 and the storage bin 116 may be equal to or greater than the maximum amount of detergent that may remain in the pump connector 124 of the detergent container 120, the pump connecting component (the pipe 150 and the valve 160), and the housing outlet hole 114.

While the present disclosure has been particularly described with reference to exemplary embodiments, it should be understood by those of skilled in the art that various changes in form and details may be made without departing from the spirit and scope of the present disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A clothing treatment apparatus, comprising:
a cabinet;
a tub disposed within the cabinet; and
a detergent supply device configured to supply detergent to the tub;
wherein the detergent supply device comprises:
a detergent container configured to store detergent;
a housing configured to receive the detergent container and supply the detergent and water to the tub; and
a connection tube including an inlet and an outlet, the inlet and the outlet are in communication with the housing to allow the detergent supplied from the housing through the inlet to be stored in the connection tube and the outlet is in communication with the housing at a higher position than the inlet, and
wherein the inlet and outlet of the connection tube are in communication with a rear wall of the housing.

2. The clothing treatment apparatus of claim 1, wherein a center of the outlet of the connection tube is configured to communicate with the housing at a higher position than a center of the inlet.

3. The clothing treatment apparatus of claim 2, wherein a lower end of the outlet of the connection tube is configured to communicate with the housing at a higher position than the center of the inlet.

4. The clothing treatment apparatus of claim 1, wherein the housing includes a storage bin configured to receive the detergent supplied from the detergent container and communicate with the inlet of the connection tube.

5. The clothing treatment apparatus of claim 4, wherein:
the rear wall is disposed on a rear side of the detergent container, and includes a blocking portion defining one side of a storage space of the storage bin,
the inlet of the connection tube is configured to communicate with the blocking portion of the rear wall, and
the outlet of the connection tube is configured to communicate with a different portion of the rear wall.

6. The clothing treatment apparatus of claim 4, further comprising a detergent pump configured to supply detergent from the detergent container to the housing,
wherein the housing includes a housing outlet hole forming a passage configured to move the detergent in the detergent container to the detergent pump, and a housing inlet hole configured to supply the detergent passing through the detergent pump into the housing, and
wherein the storage bin is configured to receive the detergent supplied from the housing outlet hole or the housing inlet hole.

7. The clothing treatment apparatus of claim 6, further comprising:
a pump connector formed protruding from a rear side of the detergent container to be coupled with the housing outlet hole of the housing,
wherein the storage bin is configured to receive the detergent leaked from the pump connector.

8. The clothing treatment apparatus of claim 4, further comprising a water supply pipe communicating with the housing to supply water from a water supply source into the housing,
wherein the storage bin is configured to receive the water supplied into the housing from the water supply pipe.

9. The clothing treatment apparatus of claim 8, wherein the connection tube forms a flow path for the detergent and the water received in the storage bin from the inlet to the outlet.

10. The clothing treatment apparatus of claim 8, wherein the housing includes a water collection guide formed on an upper portion of the storage bin and inclined downwardly toward the storage bin to guide the water supplied from the water supply pipe to the storage bin.

11. The clothing treatment apparatus of claim 4, wherein a combined volume of the connection tube and the storage bin is greater than or equal to a maximum amount of detergent that may leak from the detergent supply device.

12. The clothing treatment apparatus of claim 1, wherein:
the housing includes:
a washing water outlet hole connected to the inlet of the connection tube, and
a washing water inlet hole connected to the outlet of the connection tube, and
a center of the washing water outlet hole is located at a lower position than a center of the washing water inlet hole.

13. The clothing treatment apparatus of claim 12, wherein the center of the washing water outlet hole is located at a lower position than a lower end of the washing water inlet hole.

14. The clothing treatment apparatus of claim 1, wherein the connection tube is bent in a U shape.

15. The clothing treatment apparatus of claim 1, wherein the detergent container is detachably disposed in the housing.

16. The clothing treatment apparatus of claim 1, wherein the housing includes a guide channel elongating on a bottom of the housing to guide the water and detergent introduced into the housing through the outlet of the connection tube to the tub.

17. A clothing treatment apparatus includes:
a cabinet,
a tub disposed within the cabinet having an opening on an upper portion thereof, and
a detergent supply device disposed on an upper side the tub, wherein the detergent supply device includes:
a housing,
a detergent container configured to supply detergent to the housing,
a connection tube communicating with the housing and capable of receiving water and detergent supplied to the housing, wherein a height of an inlet through which the connection tube is supplied with water and the detergent from the housing is lower than a height of an outlet through which the connection tube is supplied with water and detergent to the housing, and wherein the inlet and outlet of the connection tube are in communication with a rear wall of the housing.

18. The clothing treatment apparatus of claim 17, wherein:

the housing includes a storage bin configured to store detergent supplied from the detergent container and water supplied from a water supply pipe, and the inlet of the connection tube may communicate with the storage bin.

19. The clothing treatment apparatus of claim 18, wherein a combined volume of the connection tube and the storage bin is greater than or equal to a maximum amount of detergent that may leak from the detergent supply device.

20. The clothing treatment apparatus of claim 17, wherein a center of the inlet is located lower than a center of the outlet.

21. The clothing treatment apparatus of claim 17, wherein a center of the inlet is located lower than a bottom of the outlet.

22. The clothing treatment apparatus of claim 17, wherein the connection tube is bent in a U shape.

* * * * *